US009964276B2

(12) United States Patent
Yamamoto

(10) Patent No.: US 9,964,276 B2
(45) Date of Patent: May 8, 2018

(54) ILLUMINATION DEVICE FOR VEHICLE HAVING ROTATABLE FIRST SHADE AND ONE PIECE COMPONENT WITH SHADES AND REFLECTOR DISPOSED IN FRONT OF FIRST SHADE

(71) Applicant: KOITO MANUFACTURING CO., LTD., Tokyo (JP)

(72) Inventor: Teruaki Yamamoto, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 162 days.

(21) Appl. No.: 15/179,640

(22) Filed: Jun. 10, 2016

(65) Prior Publication Data

US 2016/0363283 A1 Dec. 15, 2016

(30) Foreign Application Priority Data

Jun. 10, 2015 (JP) ..... 2015-117720

(51) Int. Cl.
*F21S 8/10* (2006.01)

(52) U.S. Cl.
CPC ..... *F21S 48/1794* (2013.01); *F21S 48/1159* (2013.01); *F21S 48/125* (2013.01); *F21S 48/1305* (2013.01); *F21S 48/137* (2013.01); *F21S 48/1388* (2013.01); *F21S 48/145* (2013.01); *F21S 48/31* (2013.01); *F21S 48/1258* (2013.01); *F21S 48/325* (2013.01); *F21S 48/328* (2013.01)

(58) Field of Classification Search
CPC ..... F21S 48/1784; F21S 48/1789; F21S 48/1794; F21S 48/142; F21S 48/145; F21S 48/147; F21S 48/1159; F21S 48/1305
See application file for complete search history.

(56) References Cited

U.S. PATENT DOCUMENTS 7,090,385 B2 * 8/2006 Sugimoto ..... B60Q 1/085 362/284
7,201,505 B2 * 4/2007 Sugimoto ..... F21S 48/1794 362/512
7,909,493 B2 * 3/2011 Nomura ..... F21S 48/1778 362/538

(Continued)

FOREIGN PATENT DOCUMENTS

JP 2014-010969 A 1/2014

*Primary Examiner* — Robert May
(74) *Attorney, Agent, or Firm* — Osha Liang LLP

(57) ABSTRACT

An illumination device to be mounted on a vehicle includes a light source, an optical member, a holder, a first reflector, a first shade, a driving source, a power feeding member, a second reflector, a second shade, and a third shade. The second reflector is disposed between the optical member and the first shade and configured to reflect a part of the light reflected by the first reflector toward the optical member. The second shade is disposed between the optical member and the first shade so as to block a part of the light which is not blocked by the first shade. The third shade disposed to block sunlight which passes through the optical member and reaches at least one of the holder and the power feeding member. The second reflector, the second shade and the third shade are parts of one-piece component formed of the same material.

5 Claims, 5 Drawing Sheets

(56) References Cited

U.S. PATENT DOCUMENTS

| | | | | |
|---|---|---|---|---|
| 8,459,849 | B2 * | 6/2013 | Grimm | F21S 48/1794 362/282 |
| 8,552,648 | B2 * | 10/2013 | Hayakawa | B60Q 1/143 315/80 |
| 9,664,350 | B2 * | 5/2017 | Matsumoto | F21S 48/1109 |
| 2012/0092884 | A1 * | 4/2012 | Dikau | F21S 48/1109 362/538 |

* cited by examiner

ILLUMINATION DEVICE FOR VEHICLE HAVING ROTATABLE FIRST SHADE AND ONE PIECE COMPONENT WITH SHADES AND REFLECTOR DISPOSED IN FRONT OF FIRST SHADE

CROSS-REFERENCE TO RELATED APPLICATION

This application claims priorities from Japanese Patent Application No. 2015-117720 filed on Jun. 10, 2015, the entire contents of which are incorporated herein by reference.

FIELD

The present invention relates to an illumination device to be mounted on a vehicle.

BACKGROUND

An illumination device disclosed in Patent Document 1 includes a light source, an optical member, a rotary shade, a driving source and a power feeding member. The optical member irradiates light emitted from the light source in a predetermined direction. The rotary shade is disposed between the light source and the optical member. The rotary shade is configured to be able to block a part of the light emitted from the light source by being rotated about an axis. The driving source generates a force for rotating the rotary shade. The power feeding member supplies power to the driving source.

Patent Document 1: Japanese Patent Laid-Open Publication No. 2014-010969

As described above, the optical member is arranged so as to irradiate the light emitted from the light source in the predetermined direction. However, depending on a positional relationship between a vehicle and sun, sunlight may pass through the optical member and be focused in the illumination device. It is required to take measures for preventing the components of the illumination device from being damaged by the sunlight focused in this manner.

SUMMARY

The present invention aims to provide a configuration capable of preventing components of an illumination device from being damaged by the sunlight with low cost.

In order to achieve the above object, a first aspect of the present invention provides an illumination device to be mounted on a vehicle.

The illumination device includes:

a light source;

an optical member configured to irradiate light emitted from the light source in a predetermined direction;

a holder made of resin and configured to support the optical member;

a first reflector configured to reflect a part of the light emitted from the light source toward the optical member;

a first shade disposed between the light source and the optical member and capable of blocking a part of the light emitted from the light source by being rotated or pivoted about an axis;

a driving source configured to generate a force for rotating or pivoting the first shade;

a power feeding member made of resin and configured to supply power to the driving source;

a second reflector disposed between the optical member and the first shade and configured to reflect a part of the light reflected by the first reflector toward the optical member;

a second shade disposed between the optical member and the first shade so as to block a part of the light which is not blocked by the first shade; and a third shade disposed to block sunlight which passes through the optical member and reaches at least one of the holder and the power feeding member, in which the second reflector, the second shade and the third shade are parts of one-piece component formed of the same material.

As one-piece component integral with the second reflector or the second shade which is required to be placed between the optical member and the first shade, the third shade is provided for protecting resin components which are relatively susceptible to thermal damage. In this way, it is possible to provide a configuration capable of preventing the components of the illumination device from being damaged by the sunlight with low cost.

In order to achieve the above object, a second aspect of the present invention provides an illumination device to be mounted on a vehicle.

The illumination device includes:

a light source;

an optical member configured to irradiate light emitted from the light source in a predetermined direction;

a holder made of resin and configured to support the optical member;

a first reflector configured to reflect a part of the light emitted from the light source toward the optical member;

a first shade disposed between the light source and the optical member and capable of blocking a part of the light emitted from the light source by being rotated or pivoted about an axis;

a driving source configured to generate a force for rotating or pivoting the first shade;

a power feeding member made of resin and configured to supply power to the driving source;

a second reflector disposed between the optical member and the first shade and configured to reflect a part of the light reflected by the first reflector toward the optical member;

a second shade disposed between the optical member and the first shade so as to block a part of the light which is not blocked by the first shade; and a third shade disposed to block sunlight which passes through the optical member and reaches at least one of the holder and the power feeding member, in which the second reflector is a part of a first member formed of a first material, in which at least one of the second shade and the third shade is a part of a second member formed of a second material different from the first material, and in which the first member and the second member are integrated by a bonding.

According to this configuration, the first member mainly performing a reflector function is provided separately from the second member mainly performing a light-shielding function. In this way, a degree of freedom in selecting optimal material for each member is increased. For example, in a case where the first member is formed of a stainless material, there is no need to perform a surface treatment in order to obtain a stable reflecting surface. As a result, it is possible to provide a configuration capable of preventing the components of the illumination device from being damaged by the sunlight with lower cost.

The illumination device according to each aspect described above can be configured as follows.

The first shade is a rotary shade.

When the rotary shade in which it is theoretically difficult to avoid light leakage onto the optical member side is used as the first shade, effects of the second shade become prominent.

The illumination device according to each aspect described above can be configured as follows.

The illumination device includes a support member for supporting the holder, the first shade and the driving source, and the support member has a portion disposed between the first shade and the second reflector.

That is, a shaft of the first shade and the second reflector are disposed on opposite sides across the support member. According to this configuration, it is possible to easily suppress an increase in size of a structure in a direction in which the first shade, the support member and the second reflector are arranged while ensuring a degree of freedom in shape selection and arrangement of the second reflector, as compared to a configuration in which both the shaft of the first shade and the second reflector are disposed in front of the support member.

In this case, the illumination device according to each aspect described above can be configured as follows.

The support member is pivotable about a swivel axis, and the swivel axis extends between the first shade and the second reflector.

According to this configuration, a swivel control to change an irradiation direction of light passing through the optical member in a plane perpendicular to the swivel axis can be made.

DETAILED DESCRIPTION

Hereinafter, an illustrative embodiment will be described in detail with reference to the accompanying drawings. Meanwhile, in each of the drawings used in the following description, the scale of each member is suitably changed in order to have a recognizable size.

Figure 1:
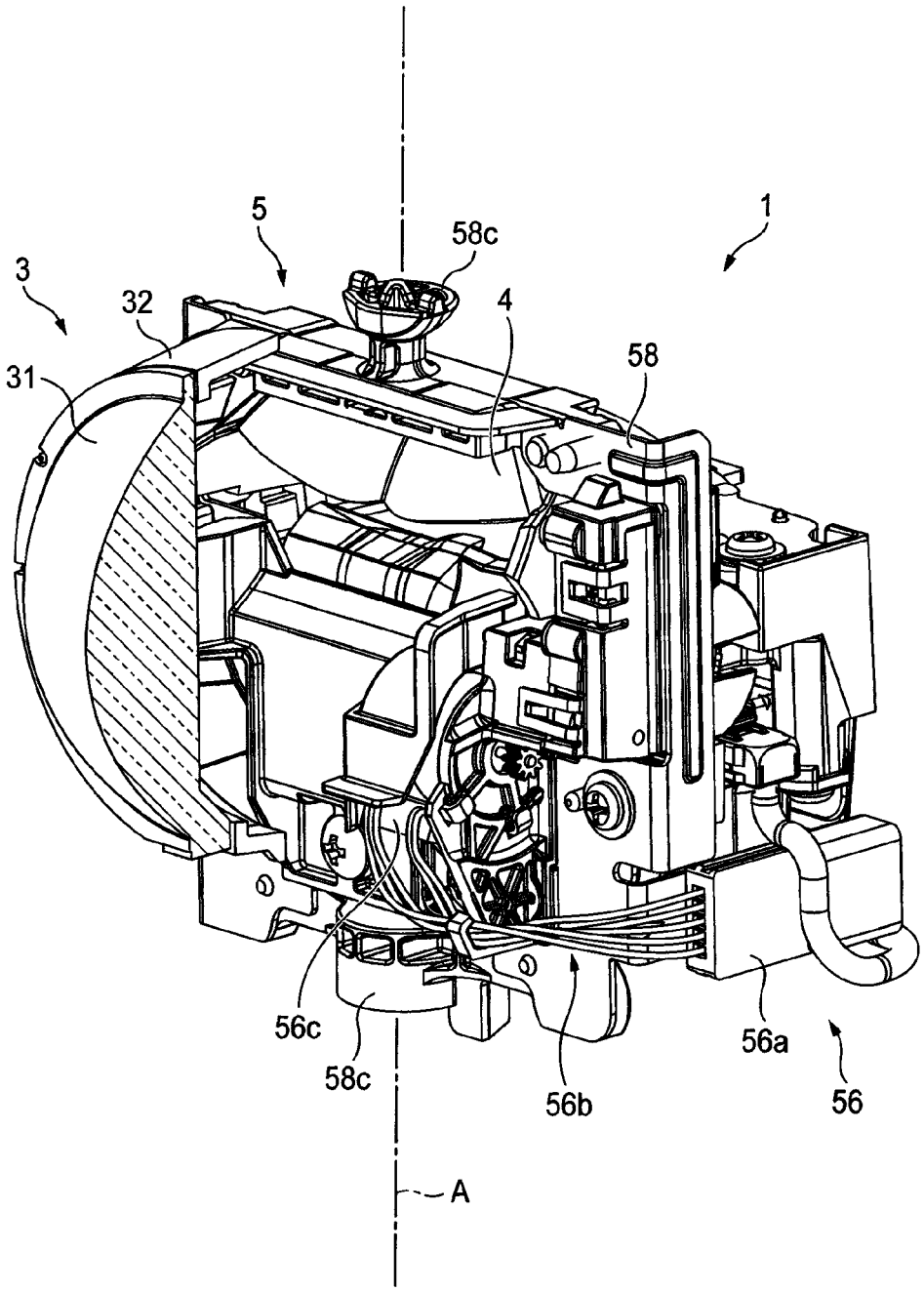
FIG. 1 is a partial sectional perspective view showing an appearance of an illumination device according to an embodiment.
Figure 2:
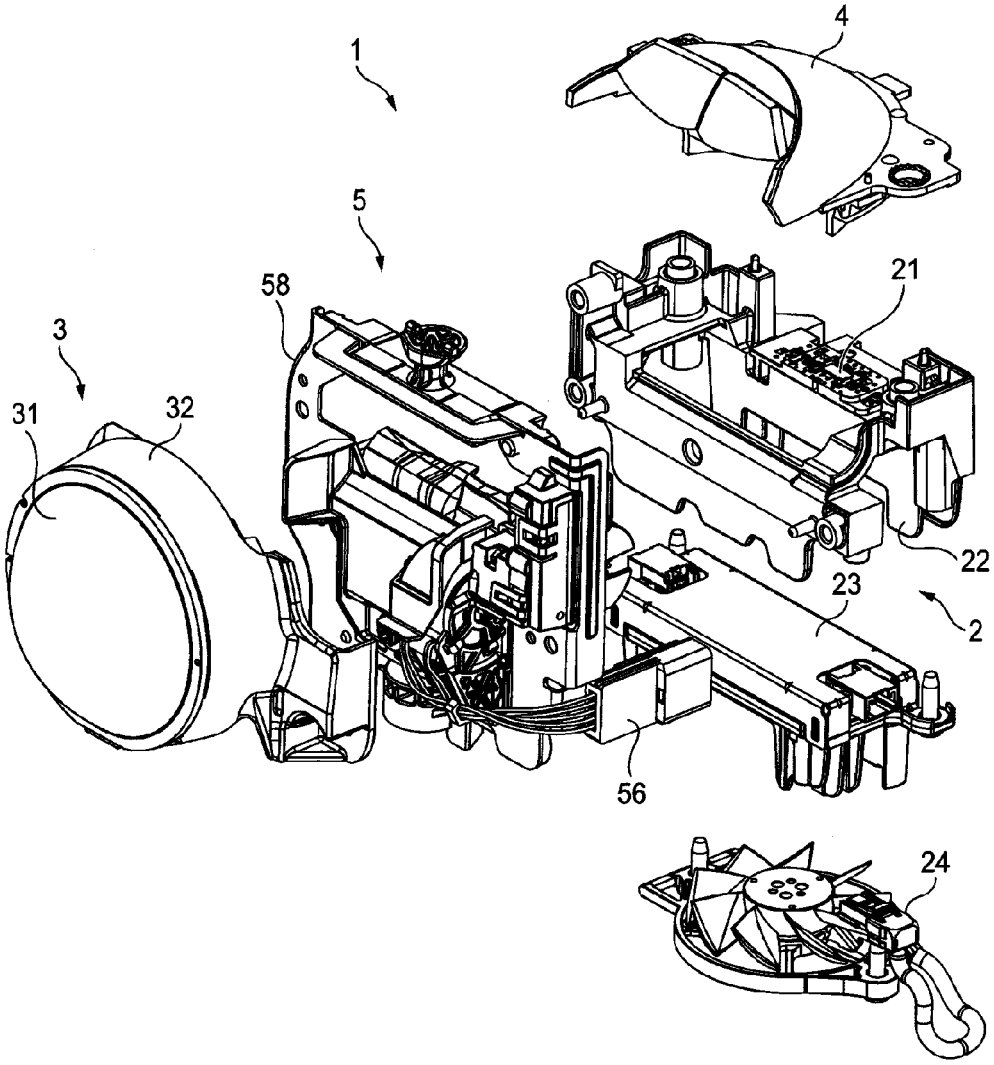
FIG. 2 is an exploded perspective view showing a configuration of the illumination device shown in FIG. 1.

FIG. 1 is a partial sectional perspective view showing an appearance of an illumination device 1 according to an embodiment. FIG. 2 is an exploded perspective view showing a configuration of the illumination device 1. For example, the illumination device 1 is a headlamp device to be mounted on a vehicle. As shown in FIGS. 1 and 2, the illumination device 1 includes a light source unit 2, a lens unit 3, a reflector 4 and a shade unit 5.

The light source unit 2 includes a light source 21, a heat sink 22, a drive control part 23 and an air-cooling fan 24. As the light source 21, a bulb light source such as an incandescent lamp and a halogen lamp, and a semiconductor light emitting element such as a light emitting diode, a laser diode an organic EL element can be suitably employed. The heat sink 22 supports the light source 21. The heat sink 22 is formed of a high thermal conductive material such as a metal. The heat sink 22 dissipates heat caused by the light emission of the light source 21. The drive control part 23 has a circuit which receives a control signal from an external control device (not shown) and controls the turn on/off of the light source 21. The air-cooling fan 24 blows air to the heat sink 22, thereby increasing the heat dissipation effect.

The lens unit 3 includes a projection lens 31 (an example of the optical member) and a lens holder 32 (an example of the holder). The projection lens 31 is formed of a translucent material. The projection lens 31 is configured so as to irradiate light emitted from the light source 21 in a predetermined direction. The lens holder 32 supports the projection lens 31. The lens holder 32 is formed of resin.

The reflector 4 is fixed to the light source unit 2. The reflector 4 is configured so as to reflect the light emitted from the light source 21 toward the projection lens 31.

Figure 3:
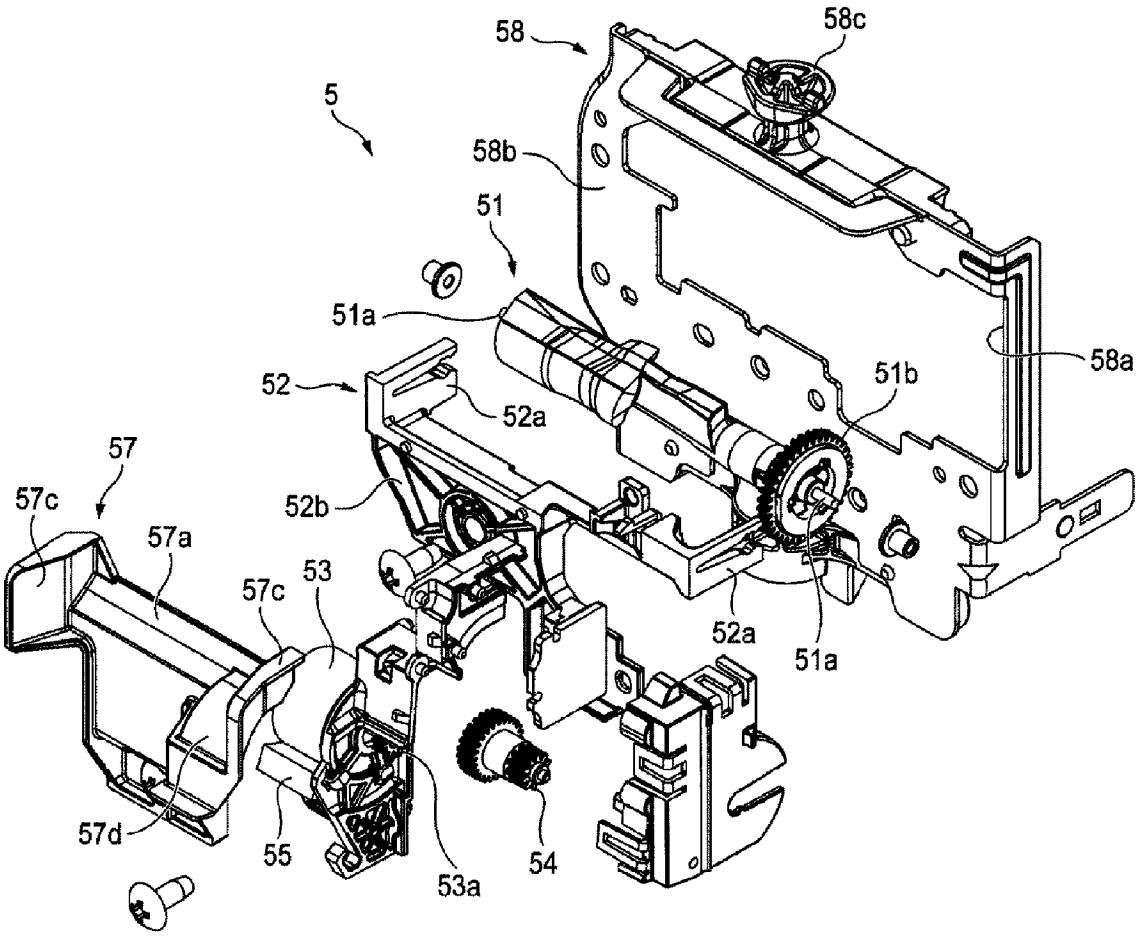
FIG. 3 is an exploded perspective view showing a configuration of a shade unit in the illumination device shown in FIG. 1.

FIG. 3 is an exploded perspective view showing a configuration of the shade unit 5. The shade unit 5 includes a rotary shade 51, a bearing member 52, a motor 53, a transmission gear 54, and a motor connector 55.

The rotary shade 51 includes a rotation shaft 51*a* and an input gear 51*b*. The bearing member 52 includes a bearing arm portion 52*a*. The rotation shaft 51*a* is supported on the bearing arm portion 52*a* so as to be rotatable about the rotation shaft 51*a*. The motor 53 (an example of the driving source) includes an output shaft 53*a* mounted with a pinion gear. Rotation of the output shaft 53*a* is transmitted to the input gear 51*b* of the rotary shade 51 via the pinion gear and the transmission gear 54. That is, the motor 53 generates a force for rotating the rotary shade 51. The motor connector 55 (an example of the power feeding member) is provided for supplying power to drive the motor 53. The motor connector 55 includes a housing made of resin.

As shown in FIGS. 1 and 2, the shade unit 5 includes a power feeding connector 56 (an example of the power feeding member). The power feeding connector 56 includes a first housing 56*a*, a power feeding wire 56*b* and a second housing 56*c*. One end of the power feeding wire 56*b* is electrically connected to a terminal provided in the first housing 56*a*. The other end of the power feeding wire 56*b* is electrically connected to a terminal provided in the second housing 56*c*. The first housing 56*a* is connected to a mating connector (not shown) and receives a signal for controlling the driving of the motor 53. The second housing 56*c* is connected to the motor connector 55. The first housing 56*a*, an outer skin of the power feeding wire 56*b* and the second housing 56*c* are made of resin.

Figure 4A:
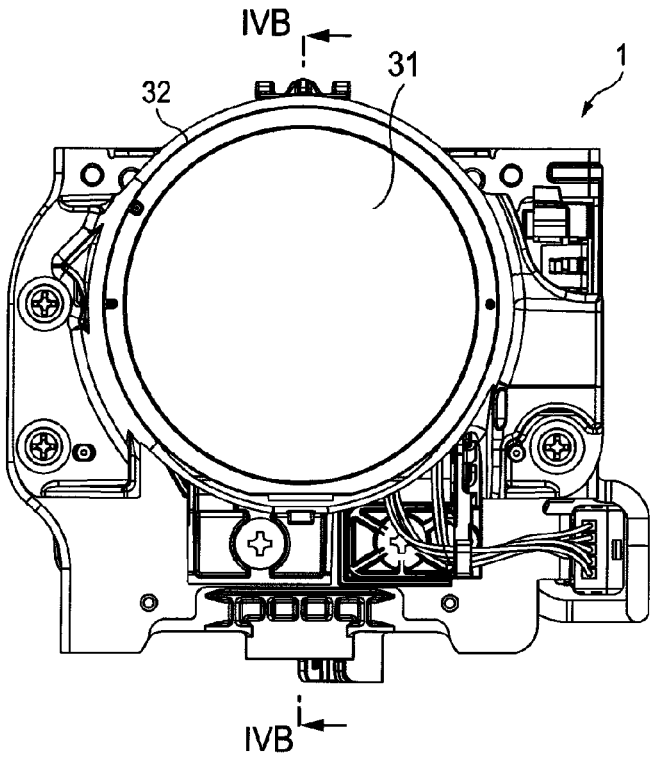
FIG. 4A is a view showing a configuration of the illumination device shown in FIG. 1.
Figure 4B:
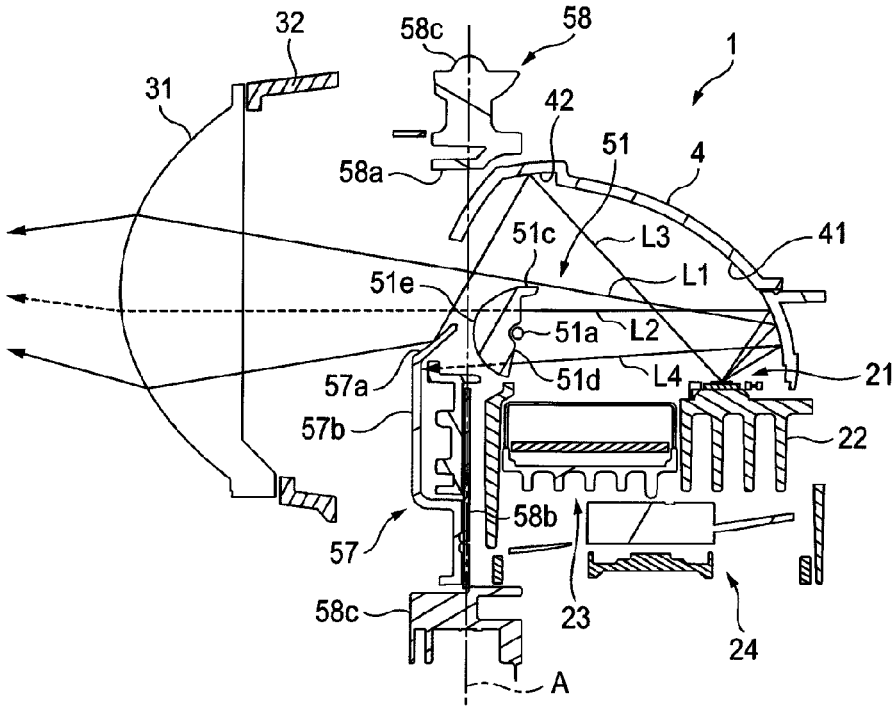
FIG. 4B is a sectional view taken along a line IVB-IVB in FIG. 4A.

FIG. 4A is a front view showing an appearance of the illumination device 1. FIG. 4B is a sectional view taken along a line IVB-IVB in FIG. 4A.

The rotary shade 51 (an example of the first shade) is disposed between the light source 21 and the projection lens 31. The rotary shade 51 has multiple kinds of end faces 51*c*, 51*d*, 51*e* which have different shapes depending on a circumferential angular position about the rotation shaft 51*a*.

The rotary shade 51 is configured to be able to block a part of the light emitted from the light source 21.

For example, as shown in FIG. 4B, when the end face 51*c* is disposed above, a light L1 passing above the end face 51*c* reaches the projection lens 31 without being blocked by the rotary shade 51. The light L1 passing through the projection lens 31 forms, for example, a low-beam pattern in front of a vehicle. An end edge shape of the end face 51*c* is projected as a cut-off line in front of the vehicle. On the other hand, in such a state, a light L2 is blocked by the rotary shade 51. When the rotary shade 51 is rotated by the motor 53, and hence, reaches a rotation angle position in which the end face 51*d* faces upward, the light L2 reaches the projection lens 31 without being blocked by the rotary shade 51, as shown in a broken line. The light L2 passed through the projection lens 31 forms, for example, a portion of a high-beam pattern in front of the vehicle.

As shown in FIGS. 3 and 4B, the shade unit 5 includes a multi-function member 57. The multi-function member 57 includes an additional reflecting portion 57*a*, a leakage light shield portion 57*b*, a first sunlight shield portion 57*c* and a second sunlight shield portion 57*d* .

The reflector 4 (an example of the first reflector) has an additional reflecting surface 42 for reflecting a light L3, in addition to a reflecting surface 41 for reflecting the light L1, L2 described above. The additional reflecting portion 57*a* (an example of the second reflector) is disposed between the projection lens 31 and the rotary shade 51. The light L3 (i.e., a part of the light emitted by the reflector 4) reflected by the additional reflecting surface 42 is reflected toward the projection lens 31 by the additional reflecting portion 57*a*. The light L3 passing through the projection lens 31 forms, for example, an additional light distribution pattern for overhead sign illumination in front of the vehicle. Here, the overhead sign means an indicator located above a head in a highway, etc.

The rotary shade 51 may have a rotation angle position in which it is theoretically difficult to avoid light leakage to the front. In an example shown in FIG. 4B, when the rotary shade 51 is rotated, and hence, the end face 51*e* faces upward, a light L4 emitted from the light source 21 passes below the end face 51*d* facing downward. The leakage light shield portion 57*b* (an example of the second shade) is disposed between the projection lens 31 and the shade 51 so as to block the light L4 (i.e., a part of the light which is not blocked by the rotary shade 51). In this way, the light leakage to the front is prevented, irrespective of the rotation angle position of the rotary shade 51.

Depending on a positional relationship between the vehicle and sun, sunlight may pass through the projection lens 31 and be focused in the illumination device 1. The first sunlight shield portion 57*c* (an example of the third shade) is disposed so as to block the sunlight which passes through the projection lens 31 and reaches the lens holder 35 by an internal reflection or the like. In this way, the lens holder 35 which is made of resin and is relatively susceptible to thermal damage can be protected from the sunlight focused. Further, the second sunlight shield portion 57*d* (an example of the third shade) is disposed so as to block the sunlight which passes through the projection lens 31 and reaches the motor connector 35 or the power feeding connector 56 by an internal reflection or the like. In this way, the motor connector 55 and the power feeding connector 56 which are made of resin and are relatively susceptible to thermal damage can be protected from the sunlight focused.

In the present embodiment, the additional reflecting portion 57*a*, the leakage light shield portion 57*b*, the first sunlight shield portion 57*c* and the second sunlight shield portion 57*d* are parts of the multi-function member 57 that is one-piece component formed of the same material. The multi-function member 57 is formed by, for example, a die-casting.

Also, in the present embodiment, as one-piece component integral with the additional reflecting portion 57*a* and the leakage light shield portion 57*b* which is required to be placed between the projection lens 31 and the rotary shade 51, the first sunlight shield portion 57*c* and the second sunlight shield portion 57*d* are provided for protecting resin components which are relatively susceptible to thermal damage. In this way, it is possible to provide a configuration capable of preventing the components of the illumination device from being damaged by the sunlight with low cost.

Figure 5A:
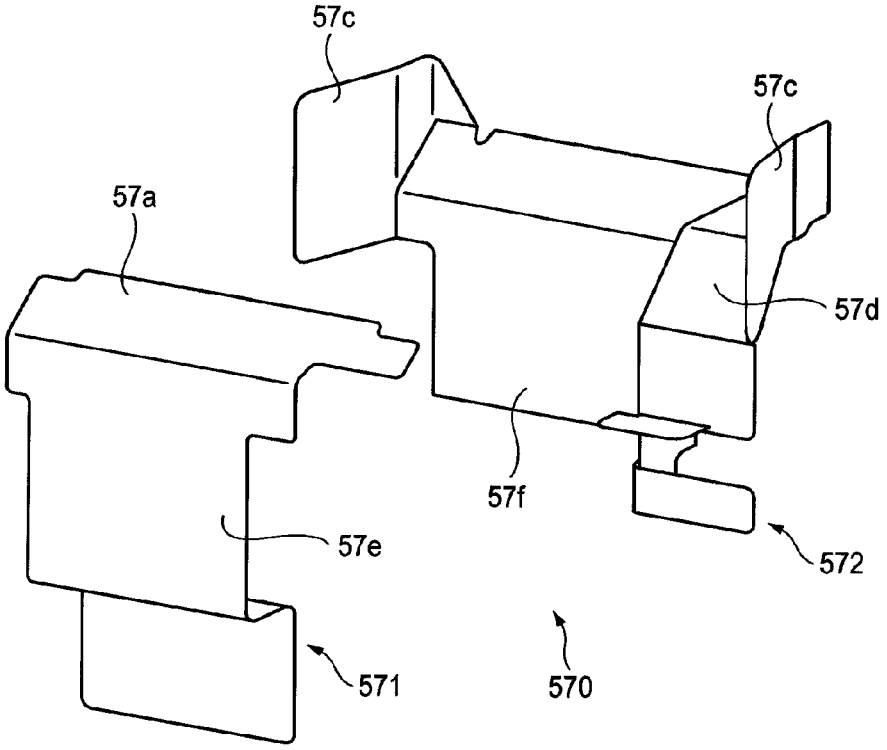
FIG. 5A is a view showing another example of a multifunction member in the illumination device shown in FIG. 1.

FIG. 5A shows a multi-function member 570 according to a modified example. The multi-function member 570 includes a first member 571 and a second member 572. The first member 571 is formed of a stainless plate or a plated steel plate (an example of the first material). The first member 571 includes the additional reflecting portion 57*a* and a first joining portion 57*e*. The second member 572 is formed of a steel plate or an aluminum plate (an example of the second material). The second member 572 includes the first sunlight shield portion 57*c*, the second sunlight shield portion 57*d*, and a second joining portion 57*f*.

Figure 5B:
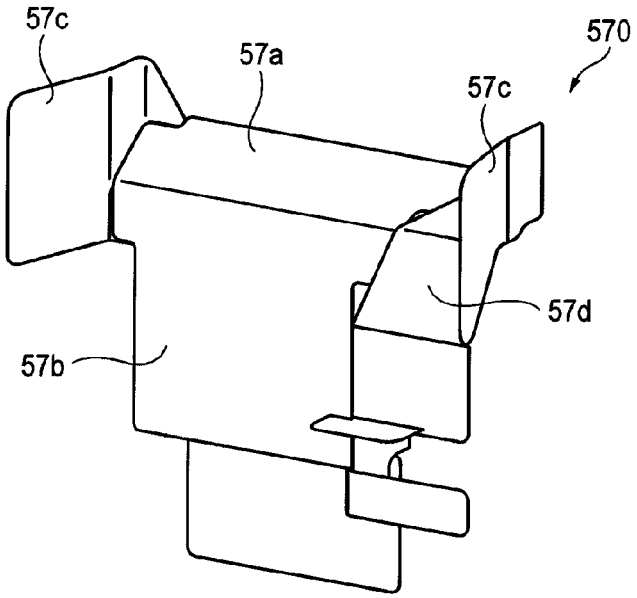
FIG. 5B is a view showing another example of a multifunction member in the illumination device shown in FIG. 1

As shown in FIG. 5B, the multi-function member 570 is integrally formed by joining the first member 571 and the second member 572. Specifically, the first joining portion 57*e* of the first member 571 is joined to the second joining portion 57*f* of the second member 572. The joining is performed by a welding, a fusing or a bonding, or by using a fastening member (caulking or rivet, etc.). The first joining portion 57*e* and the second joining portion 57*f*, which are joined, serve as the leakage light shield portion 57*b*.

Meanwhile, the portion serving as the leakage light shield portion 57*b* is not necessarily formed by both the first joining portion 57*e* and the second joining portion 57*f*. Only one of the first joining portion 57*e* and the second joining portion 57*f* may serve as the leakage light shield portion 57*b*.

Since the multi-function member 57 described above has a complicated shape, the multi-function member 57 is manufactured by a die-casting or the like. However, a surface treatment such as plating is required in order to stabilize the reflectivity of the additional reflecting portion 57*a*. In the case of the present modified example, the first member 571 mainly performing a reflector function is provided separately from the second member 572 mainly performing a light-shielding function. In this way, a degree of freedom in selecting optimal material for each member is improved. For example, in a case where the first member 571 is formed of a stainless material, there is no need to perform a surface treatment in order to obtain a stable reflecting surface. As a result, it is possible to provide a configuration capable of preventing the components of the illumination device from being damaged by the sunlight with lower cost.

As shown in FIGS. 1 to 4, the illumination device 1 includes a support member 58. The support member 58 has a plate portion 58*b* in which an opening 58*a* is formed. As shown in FIG. 3, the bearing member 52 has a base portion 52*b*. The base portion 52*b* is mounted on a front surface (surface on the side facing the projection lens 31) of the plate portion 58*b* of the support member 58. At this time, the bearing arm portion 52*a*, on which the rotary shade 51 is rotatably supported, extends to the back side (side facing the light source 21) through the opening 58*a* of the support member 58. In this way, the rotary shade 51 is disposed on the back side of the plate portion 58*b* of the support member 58. The light source unit 2 is fixed to the back side of the plate portion 58*b*.

The motor 53 and the multi-function member 57 are mounted on the base portion 52*b* of the bearing member 52. Thus, the motor 53 and the multi-function member 57 are supported by the support member 58. Further, as shown in FIG. 1, the lens holder 32 is mounted on the plate portion 58*b* of the support member 58. Thus, the lens holder 32 is supported by the support member 58. As a result, the plate portion 58*b* of the support member 58 is disposed between the rotary shade 51 and the additional reflecting portion 57*a*.

That is, the additional reflecting portion 57*a* and the shaft 51*a* of the rotary shade 51 are disposed on opposite sides across the plate portion 58*b* of the support member 58. According to this configuration, it is possible to easily suppress an increase in size in the longitudinal direction of the illumination device 1 while ensuring a degree of freedom in shape selection and arrangement of the additional reflecting portion 57*a*, as compared to a configuration in which both the shaft 51*a* of the rotary shade 51 and the additional reflecting portion 57*a* are disposed in front of the plate portion 58*a*.

As shown in FIGS. 1, 3 and 4B, a swivel shaft portion 58*c* is provided at upper and lower ends of the plate portion 58*b* of the support member 58. The support member 58 is pivotable about a swivel axis A passing through the swivel shaft portion 58*c* in a plane perpendicular to the swivel axis A. That is, the swivel axis A extends between the rotary shade 51 and the additional reflecting portion 57*a*. In this way, a swivel control to change an irradiation direction of light passing through the projection lens 31 in a lateral direction of a vehicle can be made.

The above embodiment is merely an example for facilitating the understanding of the present invention. The configurations according to the above embodiment can be suitably changed and modified without departing the gist of the present invention. Further, it is obvious that equivalents are included in the technical scope of the present invention.

The rotary shade 51 as an example of the first shade can be substituted with a shutter-type shade which switches a blocking state and a non-blocking state by being pivoted about a pivot axis. In this case, the motor as an example of the driving source can be substituted with an actuator using a solenoid or the like.

The projection lens 31 is not necessarily required to have a lens function. A scattering function or the like can be given to the projection lens, so long as a portion of the light emitted from the light source 21 can pass through the projection lens and can be irradiated in a predetermined direction.

In the multi-function member 57 or the multi-function member 570, any one of the first sunlight shield portion 57*c* and the second sunlight shield portion 57*d* can be omitted depending on the specification of the illumination device 1.

The invention claimed is:

1. An illumination device to be mounted on a vehicle comprising:

a light source;

an optical member configured to irradiate light emitted from the light source in a predetermined direction;

a holder made of resin and configured to support the optical member;

a first reflector configured to reflect a part of the light emitted from the light source toward the optical member;

a first shade disposed between the light source and the optical member and capable of blocking a part of the light emitted from the light source by being rotated or pivoted about an axis;

a driving source configured to generate a force for rotating or pivoting the first shade;

a power feeding member made of resin and configured to supply power to the driving source;

a second reflector disposed between the optical member and the first shade and configured to reflect a part of the light reflected by the first reflector toward the optical member;

a second shade disposed between the optical member and the first shade so as to block a part of the light which is not blocked by the first shade; and a third shade disposed to block sunlight which passes through the optical member and reaches at least one of the holder and the power feeding member, wherein the second reflector, the second shade and the third shade are parts of one-piece component formed of the same material.

2. An illumination device to be mounted on a vehicle comprising:

a light source;

an optical member configured to irradiate light emitted from the light source in a predetermined direction;

a holder made of resin and configured to support the optical member;

a first reflector configured to reflect a part of the light emitted from the light source toward the optical member;

a first shade disposed between the light source and the optical member and capable of blocking a part of the light emitted from the light source by being rotated or pivoted about an axis;

a driving source configured to generate a force for rotating or pivoting the first shade;

a power feeding member made of resin and configured to supply power to the driving source;

a second reflector disposed between the optical member and the first shade and configured to reflect a part of the light reflected by the first reflector toward the optical member;

a second shade disposed between the optical member and the first shade so as to block a part of the light which is not blocked by the first shade; and a third shade disposed to block sunlight which passes through the optical member and reaches at least one of the holder and the power feeding member, wherein the second reflector is a part of a first member formed of a first material, wherein at least one of the second shade and the third shade is a part of a second member formed of a second material different from the first material, and wherein the first member and the second member are integrated by a bonding.

3. The illumination device according to claim 1, wherein the first shade is a rotary shade.

4. The illumination device according to claim 1, wherein the illumination device further comprises a support member for supporting the holder, the first shade and the driving source, and wherein the support member comprises a portion disposed between the first shade and the second reflector.

5. The illumination device according to claim 4 wherein the support member is pivotable about a swivel axis, and wherein the swivel axis extends between the first shade and the second reflector.

* * * * *